United States Patent [19]

Regnier et al.

[11] Patent Number: 5,030,115

[45] Date of Patent: Jul. 9, 1991

[54] TIRED SOCKET ASSEMBLY WITH INTEGRAL GROUND SHIELD

[75] Inventors: Kent E. Regnier, Lombard; Stacey E. Caldwell, Willowbrook, both of Ill.

[73] Assignee: Molex Incorporated, Lisle, Ill.

[21] Appl. No.: 556,227

[22] Filed: Jul. 23, 1990

[51] Int. Cl.[5] ..... H01R 9/09; H01R 23/70

[52] U.S. Cl. ..... 439/108; 439/540

[58] Field of Search ..... 439/59-62, 439/79, 80, 108, 540, 541, 607, 608, 326, 629, 630

[56] References Cited

U.S. PATENT DOCUMENTS 4,806,109 2/1989 Manabe et al. ..... 439/108
4,818,239 4/1989 Erk ..... 439/540
4,874,319 10/1989 Hasircoglu ..... 439/108
4,878,856 11/1989 Maxwell ..... 439/540

*Primary Examiner*—Neil Abrams
*Attorney, Agent, or Firm*—Louis A. Hecht; Stephen Z. Weiss; Charles S. Cohen

[57] ABSTRACT

A socket assembly is provided for receiving memory modules such as single in-line memory modules (SIMMs). The socket assembly includes at least one lower tier SIMM socket that is mountable to a board. A carrier is mounted to the board in generally parallel spaced relationship to the lower tier SIMM socket. At least one upper tier SIMM socket is mounted to the carrier and may be supported in part by a lower tier SIMM socket. The carrier includes a ground shield for preventing interference.

18 Claims, 6 Drawing Sheets

TIRED SOCKET ASSEMBLY WITH INTEGRAL GROUND SHIELD

BACKGROUND OF THE INVENTION

A single in-line memory module (SIMM) comprises a generally planar substrate on which a complex array of circuitry is disposed. The circuitry on the SIMM may include integrated circuit chips or other such intelligent components that are essential to the operation of computers, office machines, telecommunication equipment or other such electrical or electromechanical devices. One edge of the planar substrate of the SIMM typically is provided with a linear array of discrete conductive regions which are electrically connected to the other circuitry on the SIMM, and which enable the SIMM to be electrically engaged with a socket.

The typical prior art SIMM socket includes a molded plastic housing having an elongated slot for receiving the edge of the SIMM. The socket further includes electrically conductive terminals spaced along the length of the slot to electrically contact the discrete conductive regions of the SIMM.

It is desirable to achieve high normal contact forces between the terminals of the socket and the discrete conductive regions along the edge of the SIMM. However, it also is necessary to minimize the insertion forces as the edge of the SIMM is urged into contact with the terminals of the socket. Many prior art SIMM sockets are constructed for a mere pushing and pulling of the SIMM along its own plane into the slot of the socket. However, push-pull SIMM sockets make it difficult to achieve both a low insertion force and a high normal contact force between the terminals and the edge of the fully inserted SIMM. More recent prior art SIMM sockets are designed to enable the SIMM to be inserted into the slot of the socket in a first angular alignment with a low insertion force, and then enable the SIMM to be rotated into a second angular alignment in which a high normal contact force is exerted by the terminals against the discrete conductive regions of the SIMM. These prior art SIMM sockets further include means for defining the range of rotation of the SIMM corresponding to optimum contact forces between the terminals of the socket and the conductive regions of the SIMM. Additionally, these prior art SIMM sockets include polarization means, positioning projections and latches all for properly aligning, positioning and retaining the SIMM in the socket. Examples of such prior art SIMM sockets that have proved to be extremely successful are shown in U.S. Pat. No. 4,575,172 which issued to Walse et al. on Mar. 11, 1986 and U.S. Pat. No. 4,713,013 which issued to Regnier et al. on Dec. 15, 1987. The two above identified patents are assigned to the assignee of the subject invention, and the disclosures thereof are incorporated herein by reference.

Electronic devices such as computers, office machines and telecommunications equipment continue to become both more complex and smaller. These simultaneous trends necessarily require electrical components having lower profiles and internal circuitry of much greater density. The more closely disposed components and the associated electrical connectors create the potential for interference or cross-talk between adjacent arrays of signal carrying circuits. Additionally, the very close proximity of these electrical components creates the potential for local generation of undesirably high temperatures that may not be adequately dissipated.

The close spacing of connectors also can create the potential for inadvertent contact between the SIMM and the fragile solder tails of a socket as the SIMM is being inserted or removed.

The prior art has included socket means for increasing the density of the circuitry in an electrical apparatus. In particular, complex SIMM socket housings have been developed for receiving a plurality of SIMMs therein. For example, a connector for receiving two SIMMs is shown in U.S. Pat. No. 4,756,694 which issued to Billman et al. on July 12, 1988. The connector shown in U.S. Pat. No. 4,756,694 is constructed for the above described pushing and pulling of the SIMM into or out of the socket, such that in their fully seated conditions the SIMMs are parallel to one another and aligned to the plane of the board on which the sockets are mounted at an angle of approximately 30°. As noted above, the push-pull arrangement required by the connector shown in U.S. Pat. No. 4,756,694 is undesirable for many applications. Furthermore, the dual socket arrangements as shown in U.S. Pat. No. 4,756,694 necessarily requires a dedicated socket housing that is not likely to be widely applicable from one electrical apparatus to the next. The tooling costs associated with the housings for such connectors is very high. Thus, the dual socket shown in U.S. Pat. No. 4,756,694 requires a significant initial investment in a socket that may have limited applicability. Also, the acute angle alignment of the SIMM to the circuit board requires a higher profile than is available for many applications, such as the various boards for peripherals that may be plugged into a computer.

Prior art sockets with ground plates or shields also are employed in the prior art. In the typical prior art socket, the ground plate will mechanically attach to an exterior region of a socket assembly to extend around a plurality of exterior surfaces for providing the desired grounding and shielding functions. An example of such a grounded or shielded connector is shown in U.S. Pat. No. 4,623,211 which issued to Dambach et al. on Nov. 18, 1986 and which is assigned to the assignee of the subject invention. Still other such grounded or shielded connectors are shown in U.S. Pat. No. 4,806,109 which issued to Manabe et al. on Feb. 21, 1989 and in U.S. Pat. No. 4,874,319 which issued to Hasircoglu on Oct. 7, 1989. The prior art grounded or shielded connectors described above have achieved various degrees of commercial and engineering acceptance, but are not adapted for use with SIMM sockets.

Accordingly, it is an object of the subject invention to provide a SIMM socket assembly for efficiently receiving a plurality of SIMMs.

It is another object of the subject invention to provide a SIMM socket assembly which comprises a plurality of separate SIMM sockets that are assembled into a tiered high density configuration.

It is another object of the subject invention to provide a SIMM socket assembly having shield means for preventing interference and cross-talk between adjacent circuits.

It is another object of the subject invention to provide a modular assembly of components for forming a high density tiered SIMM socket assembly.

SUMMARY OF THE INVENTION

The subject invention is directed to an assembly comprising a plurality of sockets for electrically contacting the discrete conductive regions on a memory module, such as a single in-line memory module (SIMM). Each socket of the subject assembly comprises an elongated molded plastic housing having an elongated slot for receiving an edge of the SIMM. Each socket further comprises electrically conductive terminals for engaging the conductive regions on the edge of the SIMM inserted into the slot. The housing and the terminals of each socket in the subject assembly preferably are constructed to receive the SIMM at a first angle with a negligible insertion force, and to permit rotation of the SIMM into a second angular alignment at which a high normal contact force is achieved between the terminals in the socket and the conductive regions along the edge of the SIMM. Each SIMM socket may further include means for lockingly retaining the SIMM in an angular alignment corresponding to full insertion, as well as means for ensuring polarization and for preventing movement of the SIMM within its own plane.

The SIMM socket assembly of the subject invention comprises means for mounting the assembly to a board, such as the board for a peripheral of a personal computer. The board mounting means of the socket assembly may comprise unitarily molded plastic mounting pegs having deflectable portions for engaging areas of the board adjacent a mounting aperture therein. Alternatively, the board mounting means may comprise separate metallic latches that may be engageable with both the socket assembly and with the board for achieving secure mounting.

The SIMM sockets of the subject assembly may be disposed in a tiered disposition with respect to one another. More particularly, the sockets of the subject assembly may be disposed such that the SIMMs mounted therein are generally parallel to one another. Additionally, the tiered disposition of sockets may be such that the respective SIMMs mounted therein are generally parallel to the board to which the subject assembly is mounted, but at different distances therefrom.

The tiered disposition of the SIMM sockets in the subject assembly may be achieved by employing at least one carrier that is mountable to the circuit board and to which a SIMM socket is engageable. More particularly, the assembly may comprise at least one elongated lower tier SIMM socket mounted directly to a board and an elongated carrier mounted to the board in spaced parallel relationship to the lower tier SIMM socket. The carrier may comprise mounting means for receiving at least one upper tier SIMM socket thereon. The upper tier SIMM socket may then be securely mounted to the mounting means of the carrier. The mounting means of the carrier may define at least one aperture for receiving at least one mounting peg of the upper tier SIMM socket. The upper tier SIMM socket may further have a portion supported by the lower tier SIMM socket to ensure a specified relationship therebetween and to ensure adequate support for the upper tier SIMM socket in its spaced relationship to the circuit board.

The SIMM socket assembly may further include a ground shield disposed in proximity to the carrier and the SIMM sockets. The ground shield may comprise a generally planar conductive plate defining a portion of a grounding circuit. The plate may be lockingly disposed in the carrier of the assembly. The ground shield may be disposed to define a plane extending parallel to the board engaging tails of the terminals mounted to the upper tier SIMM socket of the assembly. Thus, the ground shield may be operative to prevent cross-talk or other such interference that may otherwise be generated from the relatively long tails extending from the upper tier SIMM socket to the board and interference generated from electrical devices in the local environment.

In a preferred embodiment, as explained further herein, the assembly may comprise a pair of oppositely directed lower tier SIMM sockets mounted to the board in appropriately spaced parallel relationship to one another. At least one carrier may be mounted to the board intermediate the lower tier SIMM sockets. The carrier may include mounting means for receiving a pair of oppositely directed upper tier SIMM sockets extending generally parallel to the lower tier sockets. This arrangement permits a total of four SIMMs to be mounted in a very small space on a board and with a very low profile. All of the SIMMs mounted in this assembly will be generally parallel to one another. The lower tier SIMMs will be oppositely directed in generally coplanar relationship at a first distance from the board. The upper tier SIMMs will also be oppositely directed and generally coplanar, but at a second distance from the board. The tiered arrangement of sockets in the subject assembly enables easy insertion and removal of each SIMM relative to the assembly of sockets. In this embodiment, the ground shield may be particularly important. The ground shield employed in this embodiment is disposed to extend between the respective upper tier SIMM sockets to prevent cross-talk or other such interference between the electrical signals carried by the closely spaced parallel arrays of terminals. The ground shield may be locked into place in the carrier.

The assembly of the subject invention is modular in nature and can effectively be designed in accordance with the particular circuitry needs and space availability of an electrical apparatus. In some embodiments, more than two tiers may be provided to achieve even greater circuit density. In other embodiments, the tiered arrangement may be disposed to have SIMMs extend in only one direction from the socket assembly.

DETAILED DESCRIPTION OF THE PREFERRED EMBODIMENTS

Figure 1:
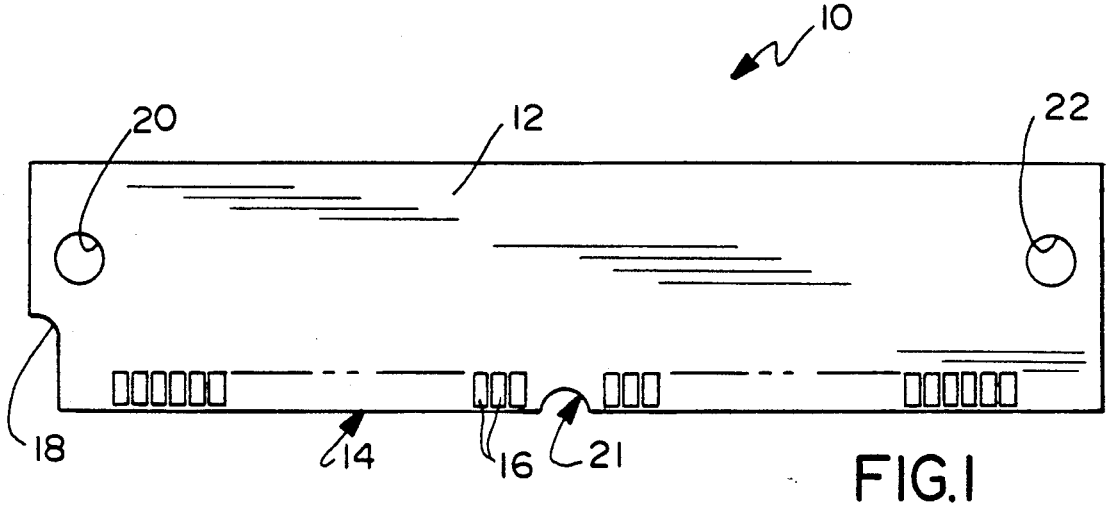
FIG.1 (PRIOR ART)
FIG. 1 is a plan view of a prior art SIMM for use with the socket assembly of the subject invention.

The socket assembly of the subject invention is specifically designed to electrically engage a plurality of single in-line memory modules (SIMMs) such as the prior art SIMM illustrated in FIG. 1 and identified generally by the numeral 10. The SIMM 10 shown in FIG. 1 includes a planar substantially rigid substrate 12 having chips and/or other circuitry (not shown) disposed thereon. The substrate 12 of the SIMM 10 includes a mating edge 14 having a plurality of discrete conductive regions 16 thereon for engaging individual terminals in a socket as explained and illustrated further herein. One longitudinal end of the SIMM is provided with a polarization notch 18 for engaging a corresponding structure on a SIMM socket to ensure proper orientation of the SIMM 10 in the socket. Centering notch 21 engages the corresponding raised centering projection 41 on the SIMM socket 24 which will provide accurate lateral alignment of each conductive region 16 along the edge 14 with a corresponding terminal in the socket. The SIMM 10 further includes a pair of mounting apertures 20 and 22 extending therethrough for engaging corresponding mounting projections on a SIMM socket. The engagement of the mounting apertures 20 and 22 with the associated projections on a SIMM socket helps to achieve proper seating of the SIMM 10 in the socket. Additionally, the engagement of the apertures 20 and 22 with the projections on a SIMM socket prevents an improper and/or unintentional pull-out of the SIMM 10.

The SIMM socket assembly of the subject invention employs a plurality of substantially identical SIMM sockets. Each SIMM socket may be substantially identical to prior art SIMM sockets, with a preferred SIMM socket being identified generally by the numeral 24 in FIGS. 2 and 3.

Figure 3:
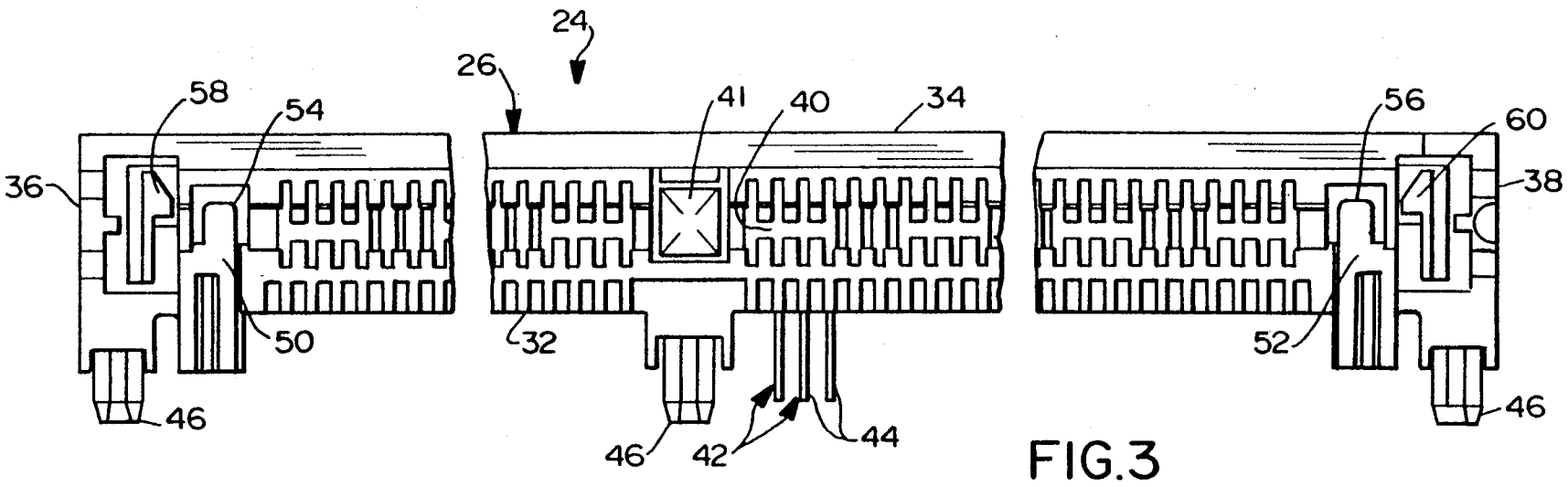
FIG. 3 is a front elevational view of the SIMM socket shown in FIG. 2.
Figure 2:
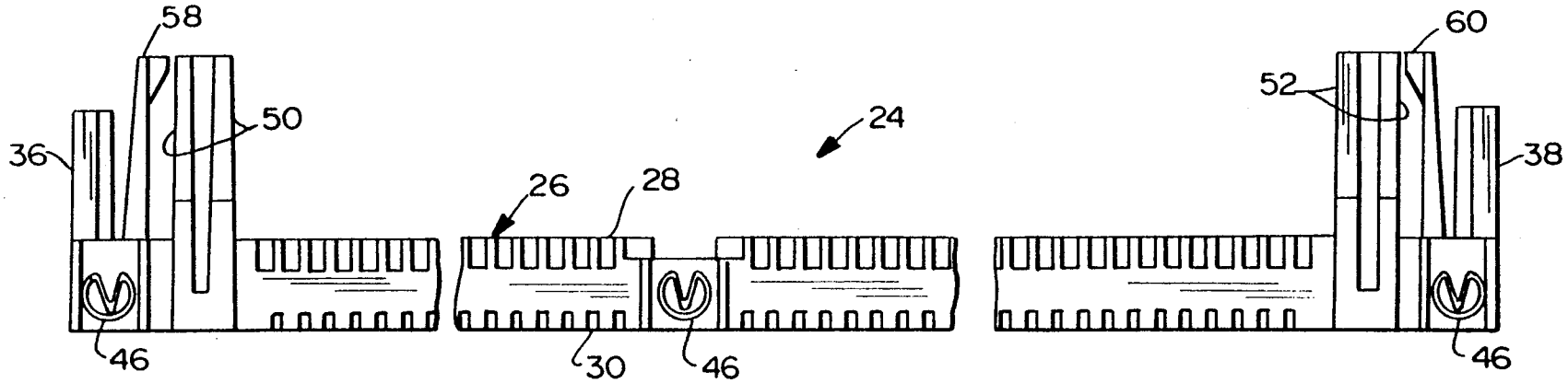
FIG. 2 is a bottom plan view of a SIMM socket for use in the assembly of the subject invention.

The SIMM socket 24 includes an elongated generally rectangular unitarily molded plastic housing 26. The housing 26 is characterized by a longitudinally extending front mating face 28, an opposed rear face 30, a longitudinally extending lower face 32 and an opposed upper face 34. The generally rectangular housing 26 is further defined by opposed longitudinal ends 36 and 38 as shown in FIGS. 2 and 3.

The front mating face 28 of the SIMM socket 24 is characterized by a longitudinally extending SIMM receiving slot 40 extending between the opposed ends 36 and 38 and dimensioned to receive the edge 14 of a prior art SIMM 10. The housing 26 is configured to accurately receive a plurality of terminals 42 having SIMM engaging contact beams projecting into the slot 40. The contact beams may be configured as illustrated and described in the above referenced U.S. Pat. No. 4,575,172. However, other SIMM engaging terminal structure may be provided. The terminals 42 are provided with solder tails 44 which are aligned to extend substantially at right angles to the SIMM engaged in the slot 40 of the housing 26. The solder tails 44 of the terminals 42 are further dimensioned to extend through holes in a circuit board to which the subject SIMM socket assembly is mounted, as explained further below.

The housing 26 of the SIMM socket 24 is molded to include unitary mounting pegs 46 on the lower surface 32 thereof. The mounting pegs 46 are disposed and dimensioned to be securely engaged in the mounting apertures into which the SIMM socket assembly is mounted. In some embodiments, separate metallic mounting pegs may be employed in lieu of the unitarily molded pegs 46 depicted herein.

As in the above described U.S. Pat. No. 4,575,172, the SIMM socket 24 of FIGS. 2 and 3 is constructed to permit a prior art SIMM 10 of FIG. 1 to be inserted at a first angle with negligible insertion forces, and to be rotated into a second angle at which a high normal contact force against the contact beams of the terminals 42 is achieved. More particularly, in the present invention, the SIMM 10 will be aligned at an acute angle to the circuit board to which the socket 26 is mounted upon initial insertion into the slot 40, and will subsequently be rotated into parallel alignment with the circuit board.

The proper seating of the prior art SIMM 10 in the SIMM socket 24 is achieved by portions of the housing 26 adjacent the opposed ends 36 and 38 respectively. More particularly, the respective ends 36 and 38 of the housing 26 are characterized by walls 50 and 52 which define the maximum range of rotation of the prior art SIMM 10. The walls 50 and 52 are characterized by projections 54 and 56 which with proper seating engage the corresponding mounting apertures 20 and 22 in the prior art SIMM 10. Additionally, the housing 26 is provided with deflectable latches 58 and 60 which are configured to initially deflect as the SIMM 10 is rotated into a final latching position, and then to resiliently return to an undeflected condition for lockingly engaging the prior art SIMM 10 against the walls 50 and 52 of the housing 26. The latches 58 and 60 may be selectively deflected away from one another to facilitate the removal of the prior art SIMM 10 from the housing 26.

Figure 4:
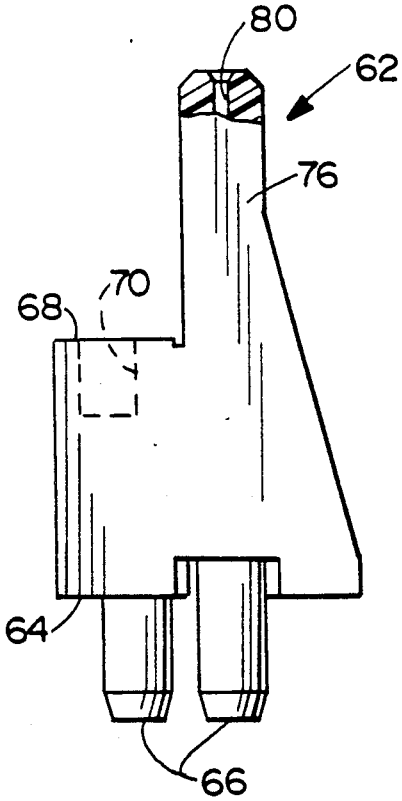
FIG. 4 is an end elevational view, partly in section, of a carrier for use in the assembly of the subject invention.
Figure 5:
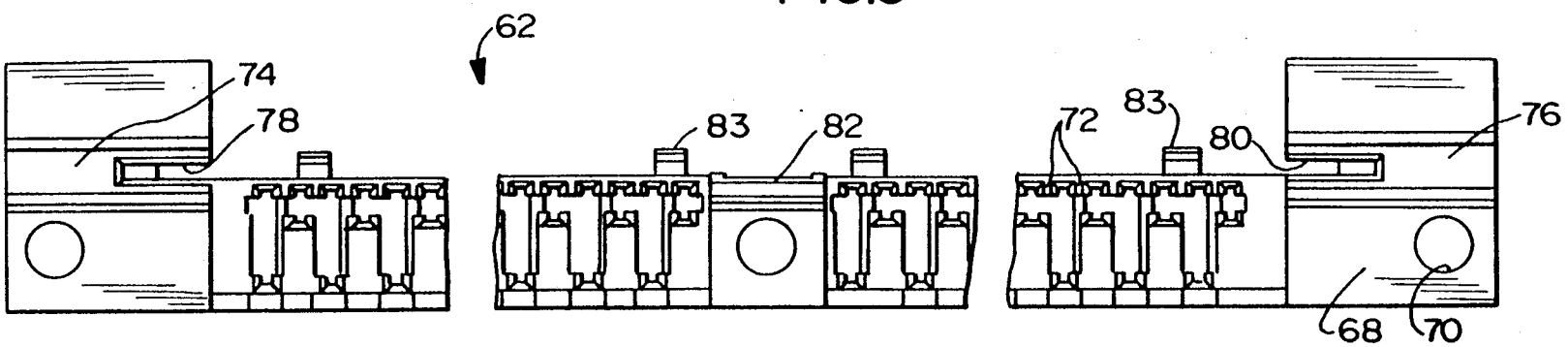
FIG. 5 is a top plan view of the carrier shown in FIG. 4.
Figure 6:
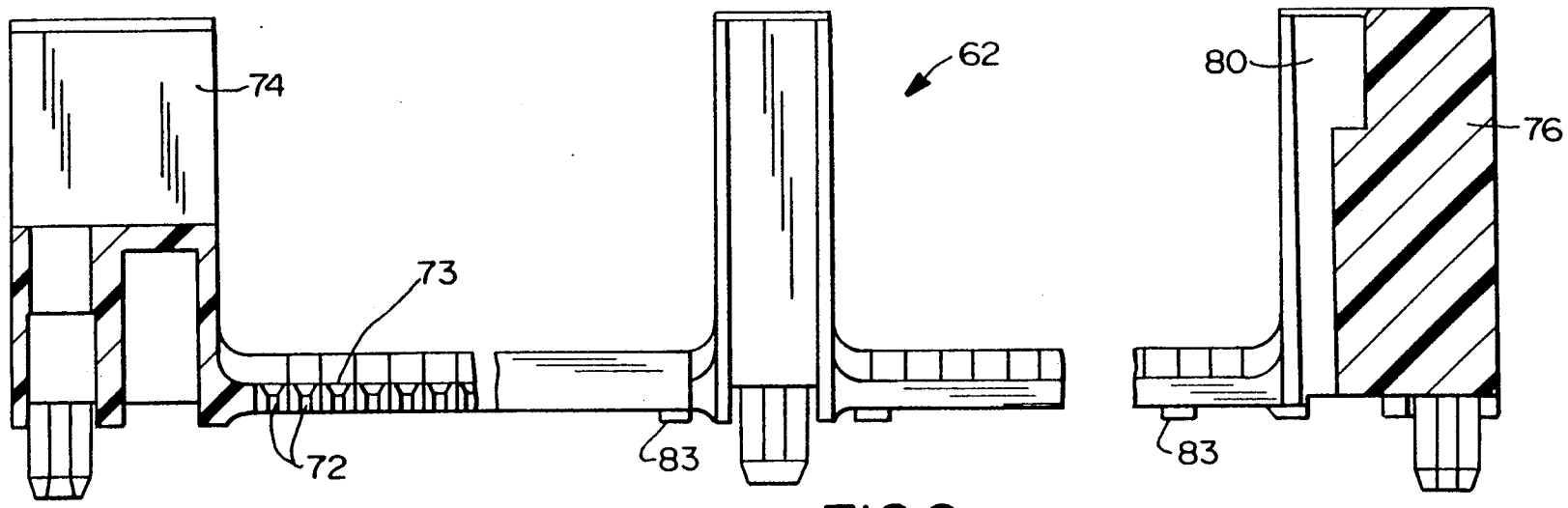
FIG. 6 is a front elevational view of the carrier shown in FIGS. 4 and 5.

The SIMM socket assembly of the subject invention further includes a carrier, one embodiment of which is identified generally by the numeral 62 in FIGS. 4–6. The carrier 62 is unitarily molded from a plastic material and defines a length substantially equal to the overall length of the SIMM socket 24. The carrier 62 includes a lower board mounting face 64 having a plurality of mounting pegs 66 extending therefrom for mounting the carrier 62 to appropriately disposed and dimensioned apertures in a circuit board. The mounting pegs 66 of the carrier 62 may be identical to the mounting pegs 46 on the SIMM socket 24. The carrier 62 further includes an opposed upper face 68 having a plurality of peg receiving cavities 70 therein for receiving the mounting pegs 46 of the SIMM socket 24. Thus, the carrier 62 can be mounted directly to a circuit board, and the SIMM socket 24 can be mounted directly to the carrier 62 as explained below. Apertures 72 extend through the carrier 62 from the intermediate upper face 73 to the lower face 64 for permitting passage of the solder tails 44 of the terminals 42 in the SIMM socket 24 mounted to the carrier 62.

The carrier 62 further comprises end ground support walls 74 and 76 extending upwardly from the upper face 68 generally adjacent the opposed longitudinal ends thereof. The end ground support walls 74 and 76 are characterized respectively by opposed facing channels 78 and 80. The carrier 62 further includes a center ground support wall 82 intermediate the end ground support walls 74 and 76. The center ground support wall 82 is generally planar to portions of the end ground support walls 74 and 76 defining the channels 78 and 80 therein. Bottom supports 83 extend into the plane of the channels 78 and 80 from the lower face 64 of the carrier 62.

Figure 7:
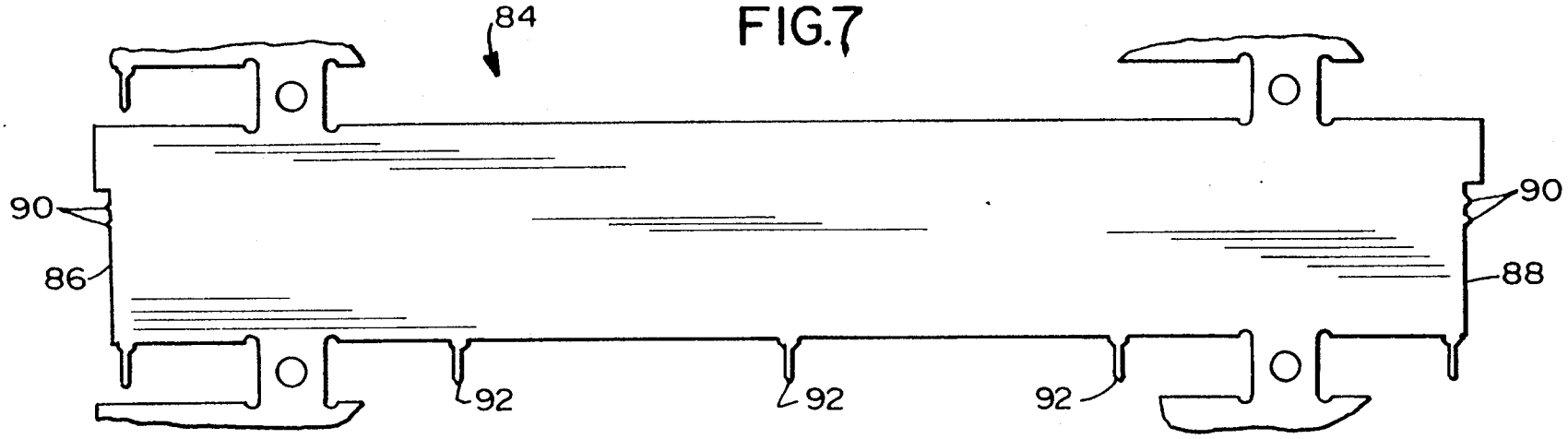
FIG. 7 is a front elevational view of the ground shield for use in the subject assembly.

The channels 78 and 80 in the end ground support walls 74 and 76 of the carrier 62 and the center ground support wall 82 thereof define a receptacle for receiving a ground shield 84 as depicted in FIG. 7. The ground shield 84 includes opposed longitudinal ends 86 and 88 for slidable mounting into the channels 78 and 80 in the end ground support walls 74 and 76. More particularly, each end 86 and 88 is stamped to define a plurality of locking tangs 90 that are dimensioned to bite into the plastic material of the carrier 62 adjacent the channels 78 and 80 in the respective end ground support walls 74 and 76. The ground shield 84 is dimensioned to be substantially in line with the tops of the respective ground support walls 74, 76 and 82 upon complete insertion of the ground shield 84 into the respective channels 78 and 80. Upon complete insertion the lower edge of the ground shield 84 will engage the bottom supports 83 of the carrier 62, the supports 83 will prevent the ground shield 84 from contacting the associated circuit board 96. The ground shield 84 is further characterized by solder tails 92 extending therefrom. The solder tails 92 are disposed and dimensioned to pass through holes in a circuit board to permit electrical connection to a grounding circuit on the board.

Figure 8:
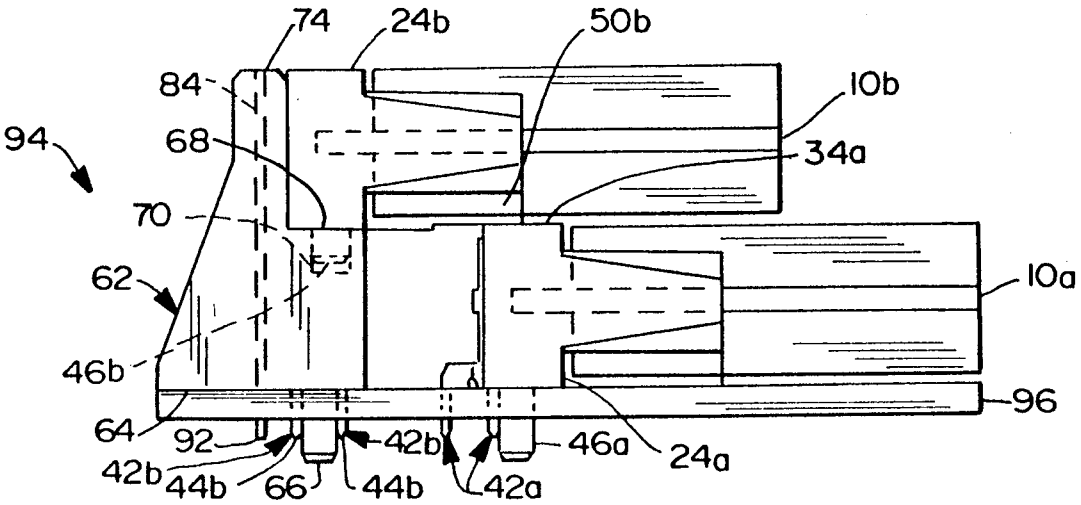
FIG. 8 is an end elevational view of the assembly formed from the components in FIGS. 2–7.

The components illustrated in FIGS. 2–7 and described above are assembled into a SIMM socket assembly which is identified generally by the numeral 94 in FIG. 8. The SIMM socket assembly 94 comprises a lower tier SIMM socket **24*a* which is mounted directly to a circuit board 96 for a computer peripheral by passing the mounting pegs 46*a* thereof through appropriate mounting apertures in the circuit board 96. The carrier 62 is mounted perpendicular to the circuit board 96 and extends substantially parallel to the lower tier SIMM socket 24*a*. In particular, the carrier 62 is mounted to the circuit board 96 by passing the mounting pegs 66 thereof through appropriately disposed and dimensioned mounting apertures in the circuit board 96. The ground shield 84 is slidably and lockably retained in the channels 78 and 80 of the carrier 62 to extend substantially orthogonal to the circuit board 96, with the solder tails 92 thereof passing through appropriate holes in the circuit board 96. The locked mounting of the ground shield 84 into the carrier 62 may be carried out after the carrier 62 has been mounted to the circuit board 96. However, it is preferred to mount the ground shield 84 into the carrier 62 beforehand to enable preassembled portions of the subject assembly 94** to be sold for easy mounting to a circuit board by a customer.

The assembly 94 further includes an upper tier SIMM socket **24*b* which is mounted to the carrier 62. More particularly, the mounting pegs 46*b* of the upper tier SIMM socket 24*b* are forced into and frictionally retained in the peg receiving cavities 70 on the upper face 68 of the carrier 62. In this condition, the upper face 68 of the carrier 62 supports a major portion of the upper tier SIMM socket 24*b*. Additionally, the solder tails 44*b* of the terminals 42*b* in the upper tier SIMM socket 24*b* pass through the apertures 72 in the carrier 62. As shown in FIG. 8, the solder tails 44*b* necessarily are fairly long to extend the distance from the upper tier SIMM socket 24*b* through the carrier 62 and through the circuit board 96. Due to their length, these solder tails 44*b* can create a local interference field that could affect the signals carried by adjacent circuits in the fairly dense circuitry of the computer or other such electrical apparatus in which the assembly 94 is disposed. Due to their length, these solder tails 44*b* can receive similar local interference. However, as depicted clearly in FIG. 8, the ground shield 84 extends substantially parallel to the solder tails 44*b* of the upper tier SIMM socket 24*b*** to substantially shield and ground any cross-talk signals that may be generated or received.

It will also be noted, with reference to FIG. 8, that the two walls of the upper tier SIMM socket **24*b*, one designated 50*b* and the other wall not shown, are supported in part by the upper face 34*a* of the lower tier SIMM socket 24*a*. Thus, the upper tier SIMM socket 24*b* is securely supported and accurately positioned by the carrier 62 and additionally supported by the lower tier SIMM socket 24*a*. It will also be noted, with reference to FIG. 8, that the SIMMs 10*a* and 10*b* mounted in the respective sockets 24*a* and 24*b* are aligned substantially parallel to the circuit board 96 to achieve a very low profile for the combined circuit board 96 and SIMM socket assembly 94. This low profile achieves a high circuit density that enables the performance of a computer or other such electrical or electromechanical apparatus to be enhanced substantially without significantly affecting the size. Furthermore, the relatively open configuration afforded by the carrier 62, as shown in FIG. 6, and the presence of the ground shield 84 facilitates circulation of air and dissipation of heat away from the terminals 42*b*. The SIMM socket assembly 94 can be assembled with SIMM sockets 24*a* and 24*b*** and can be employed in other applications that require less dense circuitry. Consequently, a complex dedicated connector housing is not required for receiving a plurality of memory modules as had been the case with many prior art socket structures.

Figure 9:
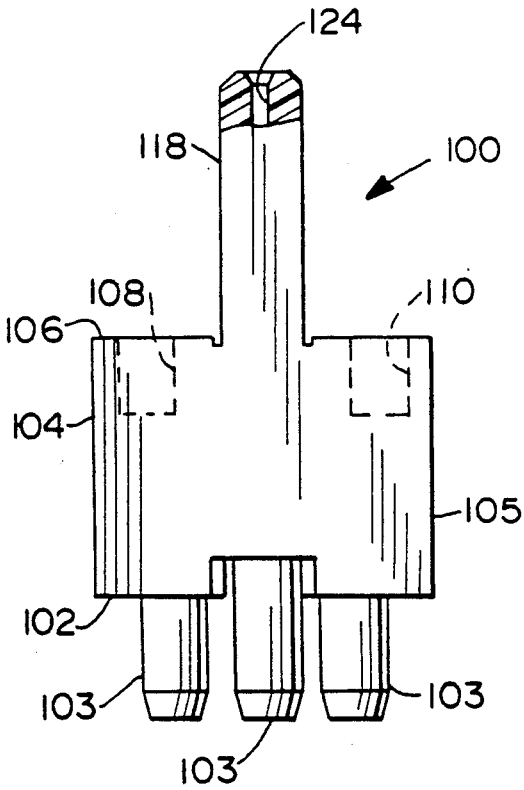
FIG. 9 is an end elevational view, partly in section, of an alternate carrier.
Figure 10:
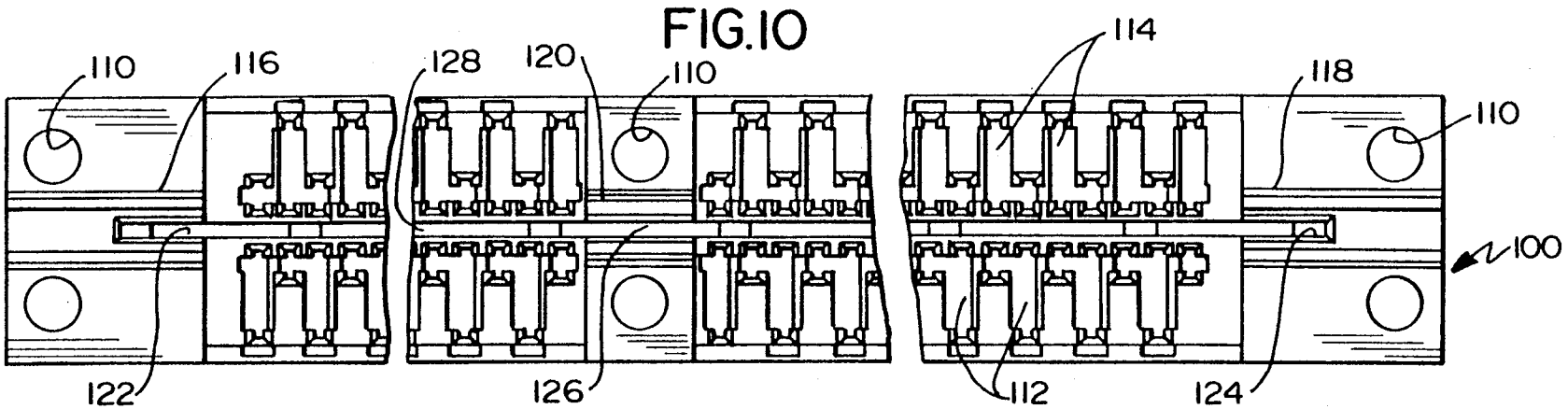
FIG. 10 is a top plan view of the carrier shown in FIG. 9.
Figure 11:
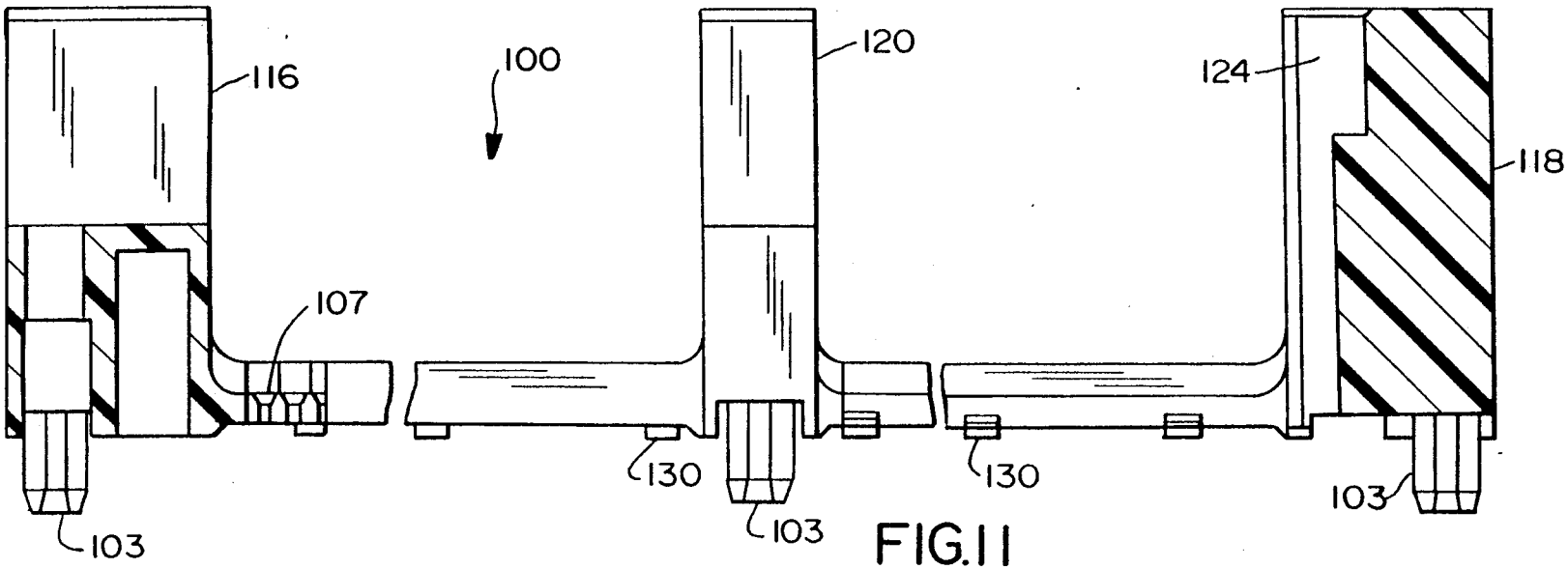
FIG. 11 is a front elevational view of the carrier shown in FIGS. 9 and 10.

An alternate carrier 100 is depicted in FIGS. 9–11. The carrier 100 includes a lower board mounting face 102 having a plurality of mounting pegs 103 extending downwardly therefrom for secure mounting to apertures in a circuit board. The carrier 100 further includes opposed first and second longitudinally extending sides 104 and 105 extending upwardly from the lower face 102 and an upper face 106. The upper face 106 of the carrier 100 is characterized by a first array of peg receiving cavities 108 disposed generally in proximity to the first longitudinal side 104 of the carrier 100 and a second array of peg receiving cavities 110 disposed generally in proximity to the second side 105. The peg receiving cavities 108 and 110 in each array are disposed and dimensioned to receive the mounting pegs 46 of the SIMM socket 24 depicted in FIGS. 2 and 3. The carrier 100 is further characterized by a first generally linear array of apertures 112 passing entirely therethrough from the upper intermediate face 107 to the lower face 102 and generally adjacent the first longitudinal side 104. Similarly, a second array of apertures 114 extends between the upper intermediate and lower faces 107 and 102 respectively and generally linearly aligned in proximity to the second longitudinal side 105 of the carrier 100. The apertures 112 and 114 in each array are disposed to receive the solder tails 44 extending from a SIMM socket 24.

The carrier 100 further includes opposed end ground support walls 116 and 118 and a center ground support wall 120. The end ground support walls 116 and 118 are characterized by opposed facing channels 122 and 124, while the center ground support wall 120 similarly is provided with a channel 126 extending entirely therethrough. The channels 122–126 define a common plane and are dimensioned to lockingly receive the ground shield 84 described above and illustrated in FIG. 7.

Additionally, the intermediate face 107 is characterized by a slot 128 in the plane of the channels 122–126 and dimensioned to receive a lower portion of the ground shield 84. The slot 128 is characterized by transverse bottom supports 130 adjacent the lower face 102 of the carrier 100 to prevent direct contact of the ground shield 84 with the circuit board to which the carrier 100 is mounted.

Figure 12:
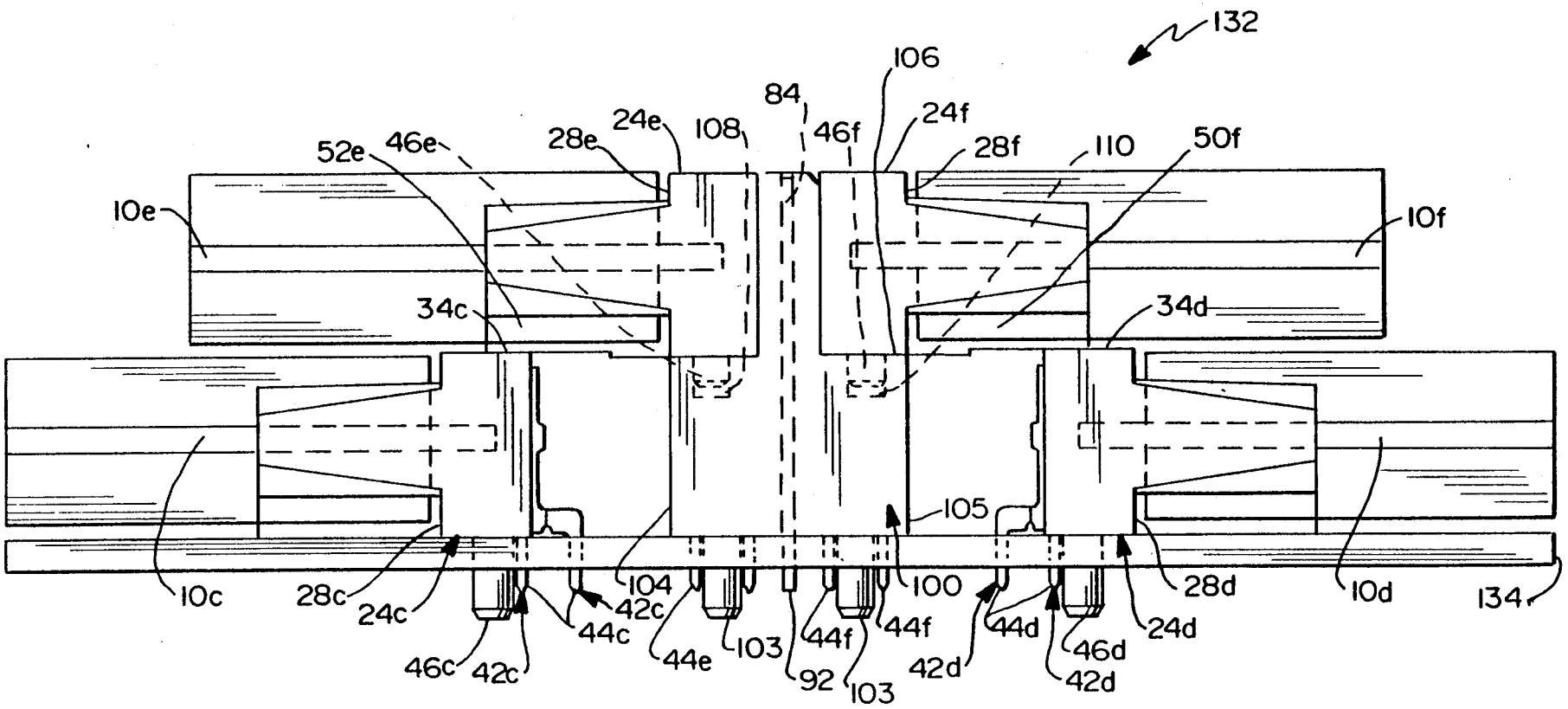
FIG. 12 is an end elevational view of the assembly formed from the components in FIGS. 2, 3, 7 and 9–11.

The carrier 100 is employed with the SIMMs, SIMM sockets and ground shield described above to define an alternate SIMM socket assembly 132 as depicted in FIG. 12. More particularly, the carrier 100 is mounted to a circuit board 134 between and parallel to first and second lower tier SIMM sockets 24*c* and 24*d* for receiving SIMMs 10*c* and 10*d*. The lower tier SIMM sockets 24*c* and 24*d* and the carrier 100 are mounted to the circuit board 134 by the respective mounting pegs 46*c*, 46*d* and 103 thereof. Additionally, the first and second lower tier SIMM sockets 24*c* and 24*d* respectively are oriented such that their front mating faces 28*c* and 28*d* are facing in opposite directions and away from one another. Thus, the SIMMs 10*c* and 10*d* extend in opposite directions in a plane parallel to the board 134.

The assembly 132 further comprises first and second upper tier SIMM sockets 24*e* and 24*f* for receiving SIMMs 10*e* and 10*f*. The first upper tier SIMM socket 24*e* is mounted to the portion of the upper face 106 of the carrier 100 in proximity to the first side 104 thereof. This mounting is such that the mounting pegs 46*e* of the SIMM socket 24*e* extend into the first array of peg receiving cavities 108 on the carrier 100. Additionally, the mounting is such that two walls of the SIMM socket 24*e*, one designated 52*e* and the other not shown, are supported on the upper face 34*c* of the first lower tier SIMM socket 24*c*. In this mounted condition, the long solder tails 44*e* of the first upper tier SIMM socket 24*e* extend downwardly through the apertures 112 adjacent the first side 104 of the carrier 100 and into electrical contact with appropriate circuitry on the board 134.

In a similar manner, the second upper tier SIMM socket 24*f* is mounted to the upper face 106 of the carrier 100 and to the upper face 34*d* of the second lower tier SIMM socket 24*d*. This mounting is rendered secure by the engagement of the mounting pegs 46*f* of the second upper tier SIMM socket 24*f* in the peg receiving cavities 110 adjacent the second longitudinal side 105 of the carrier 100. In this mounted condition, the long solder tails 44*f* extending from the second upper tier SIMM socket 24*f* will pass through the apertures 114 adjacent the second side 105 of the carrier 100. The long solder tails 44*e* and 44*f* of the respective upper tier SIMM sockets 24*e* and 24*f* are disposed in very close relationship to one another and the potential for cross-talk or other such interference therebetween exists. To prevent such cross-talk or other interference generated from electrical devices in the local environment, the SIMM socket assembly 132 is provided with the ground shield 84 which is lockingly engaged in the carrier 100. In particular, the ground shield 84 is lockingly received in the channels 122–126 and the slot 128 of the carrier 100 and substantially centrally located between the closely spaced solder tails 44*e* of the first upper tier SIMM socket 24*e* and the opposed long solder tails 44*f* of the second upper tier SIMM socket 24*f*. In this location, the ground shield is prevented from contacting the long solder tails 44*e* and 44*f* of the upper tier sockets 24*e* and 24*f*. As with the previously described embodiment, the solder tails 92 of the ground shield 84 extend into contact with ground circuitry on the circuit board 134.

The SIMM socket assembly 132 depicted in FIG. 12 achieves even greater circuit density than the previously described embodiment. More particularly, a total of four SIMMs 24*c–f* can be mounted to a single board 134 in a very small area with a low profile. The ground shield 84 lockingly engaged in the carrier 100 prevents cross-talk between the opposed circuits to ensure a high quality performance for the SIMM socket assembly 132. Additionally, the ground shield contributes to heat dissipation away from the circuitry of the SIMMs 10*c–f* and the sockets 24*c–f*. As with the previous embodiment, the assembly does not require specially tooled SIMM sockets, but employs available SIMM sockets with a unique carrier for positively supporting the sockets in a dense array and for preventing cross-talk or other such interference by the closely spaced terminals and circuits. Furthermore, the housings of the upper tier sockets 24*e* and 24*f* overlie and protect the terminals 42*c* and 42*d* of the lower tier sockets 24*c* and 24*d*.

In summary, a SIMM socket assembly is provided for achieving a very high density of SIMMs or other such memory modules for incorporation into a computer or other electrical or electromechanical apparatus. The assembly comprises at least one first tier SIMM socket that is mountable to a circuit board and at least one carrier mounted to the circuit board in generally parallel relationship to the first tier SIMM socket. At least one second tier SIMM socket is mounted at least in part to the carrier and may be supported further by a lower tier SIMM socket. The carrier includes means for permitting passage of the terminals from the upper tier SIMM socket to the board. The carrier further includes a ground shield for preventing electrical interference to or from the terminals of the SIMM sockets.

While the invention has been described with respect to certain preferred embodiments, it is apparent that various changes can be made without departing from the scope of the invention as defined by the appended claims. In particular, the SIMM sockets employed in the subject assembly may take forms different from those depicted herein. The modular assembly may further include other arrangements of SIMM sockets, including more or fewer SIMM sockets than those depicted herein. These and other variations will be apparent to a person skilled in this art after having read the subject disclosure.

I claim:

1. A modular socket assembly for electrically connecting a plurality of memory modules to a circuit board, each said memory module having a substantially planar substrate with a mating edge, said socket assembly comprising:

an elongated carrier having a lower face with board mounting means for mounting the carrier to the circuit board, an upper face having at least one mounting structure thereon, at least one ground support wall extending upwardly from the upper face;

a ground shield mounted to the ground support wall of the carrier and having termination means for electrical connection to a ground circuit on the circuit board;

a plurality of elongated sockets each of which comprises a housing having a slot for receiving the mating edge of one of said memory modules, a plurality of terminals in each housing in proximity cuit board, the upper face including socket engaging means for securely engaging a socket thereon and aperture means extending therethrough, at least one ground support wall extending upwardly from the upper face and formed to define an elongated channel;

a conductive ground shield engaged in the channel of the ground support wall of the carrier;

a plurality of elongated sockets, each said socket including a lower face with mounting structures extending therefrom, a front mating face having a slot for receiving an edge of a memory module, a rear face and an upper face, each said socket further comprising a plurality of terminals mounted therein, said terminals comprising memory module contact means disposed in proximity to the slot and board engaging tails extending to the circuit board, said plurality of sockets comprising at least one lower tier socket aligned parallel to the carrier and having its mounting structure retaining its lower face to the circuit board, the front mating face of the lower tier socket facing away from the carrier, said plurality of sockets further comprising at least one upper tier socket having its mounting structure retaining its lower face to the socket engaging means on the upper face of the carrier, said upper tier socket being disposed such that the front mating face thereof faces away from the ground shield and such that the tails of the terminals extend through the aperture means in the carrier.

15. A peripheral board as in claim 14 wherein the plurality of sockets comprises first and second lower tier sockets disposed respectively on opposite sides of the carrier and first and second upper tier sockets disposed respectively on opposite sides of the ground shield engaged in the channel of the ground support wall of the carrier.

16. A peripheral board as in claim 14 wherein the socket engaging means of the carrier defines at least one aperture extending into the upper face of the carrier, and wherein the mounting structure of each said socket comprises at least one peg selectively engageable with the aperture of the carrier.

17. A peripheral board as in claim 16 wherein the circuit board comprises a plurality of mounting apertures therein for receiving the mounting structure of the sockets, the mounting apertures in the circuit board defining cross sections substantially identical to the mounting apertures of the carrier.

18. A peripheral board as in claim 14 wherein a portion of each said upper tier socket is supported on the upper face of on of said lower tier sockets.

* * * * *